United States Patent [19]

Phillips, Jr. et al.

[11] Patent Number: 4,845,862

[45] Date of Patent: Jul. 11, 1989

[54] COLD WEATHER FOOTWEAR

[75] Inventors: James G. Phillips, Jr., Pleasant Grove, Utah; Sven E. Oberg, Waynesville; Cynthia D. Wilder, Greensboro, both of N.C.

[73] Assignee: Burlington Industries, Inc., Greensboro, N.C.

[21] Appl. No.: 24,558

[22] Filed: Mar. 11, 1987

[51] Int. Cl.[4] ..... A43B 1/10; A43B 13/38; A43B 23/07

[52] U.S. Cl. ..... 36/83; 36/4; 36/43; 36/55

[58] Field of Search ..... 36/83, 84, 88, 93, 98, 36/122, 14, 19 R, 19.5, 44, 55, 10, 49, 1.5, 4, 7.3, 117

[56] References Cited

U.S. PATENT DOCUMENTS

| | | | |
|---|---|---|---|
| 3,449,844 | 6/1969 | Spence | 36/44 |
| 3,618,232 | 11/1971 | Shnuriwsky | 36/1.5 |
| 3,691,658 | 9/1972 | DiPerno et al. | 36/4 |
| 3,694,940 | 10/1972 | Stohr | 36/88 |
| 4,170,802 | 10/1979 | Roy | 36/14 |
| 4,333,192 | 6/1982 | Stockci et al. | 36/14 |
| 4,461,099 | 7/1984 | Bailly | 36/44 |
| 4,575,956 | 3/1986 | Paris | 36/119 |
| 4,665,576 | 5/1987 | Limbach | 36/117 |
| 4,689,899 | 9/1987 | Larson et al. | 36/44 |
| 4,709,490 | 12/1987 | Fottinger et al. | 36/44 |
| 4,729,179 | 3/1988 | Quist, Jr. | 36/44 |
| 4,946,193 | 3/1976 | Giese | 36/44 |

FOREIGN PATENT DOCUMENTS

| | | | |
|---|---|---|---|
| 0212032 | 3/1987 | European Pat. Off. | 36/88 |
| 2079137 | 1/1982 | United Kingdom | 36/84 |

OTHER PUBLICATIONS

"Fieldbook" of Boy Scouts of America, pp. 46, 47, 78–89, 336, 337, Third Edition, 1984.

*Primary Examiner*—Steven N. Meyers
*Attorney, Agent, or Firm*—Nixon & Vanderhye

[57] ABSTRACT

Cold weather footwear includes at least three assemblies: an inner preformed sock comprised of inner and outer fabric layers and an intermediate open cell polyurethane foam layer enabling moisture transmission through the preformed sock; an insole assembly including a first layer formed of a moisture retaining or accumulating fabic, separable foam and intermediate sheet plastic non-moisture permeable plastic, and an underlying layer of closed cell thermally insulating foam for disposition between the inner sock and the sole of the boot; and a boot having a sole and a shell formed integrally with the boot, the shell being backcoated with a plastic material and coated with a water repellent. The footwear has adequate thermal insulation and moisture vapor transport characteristics, while affording good wind resistance and water repellency.

43 Claims, 3 Drawing Sheets

FIG. 7b
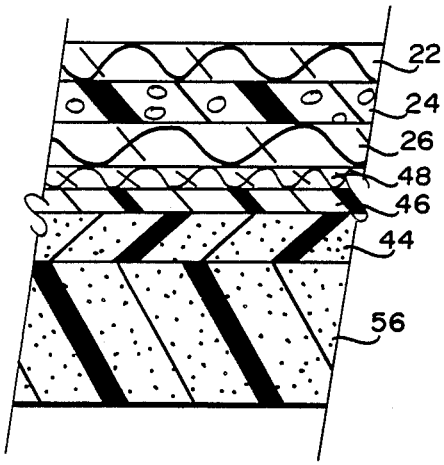
FIG. 3
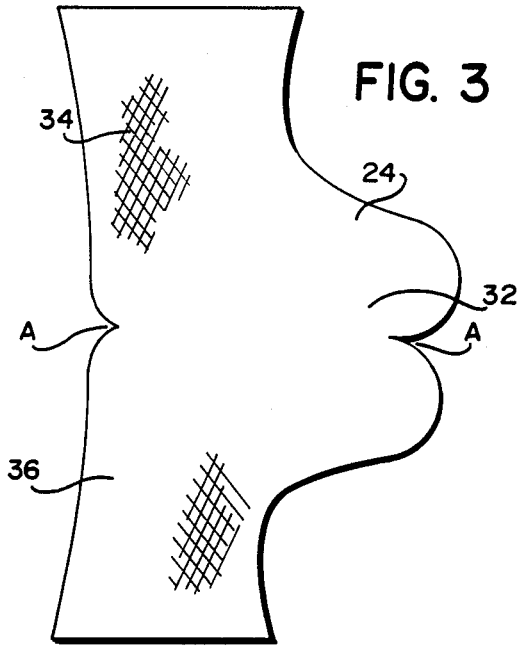
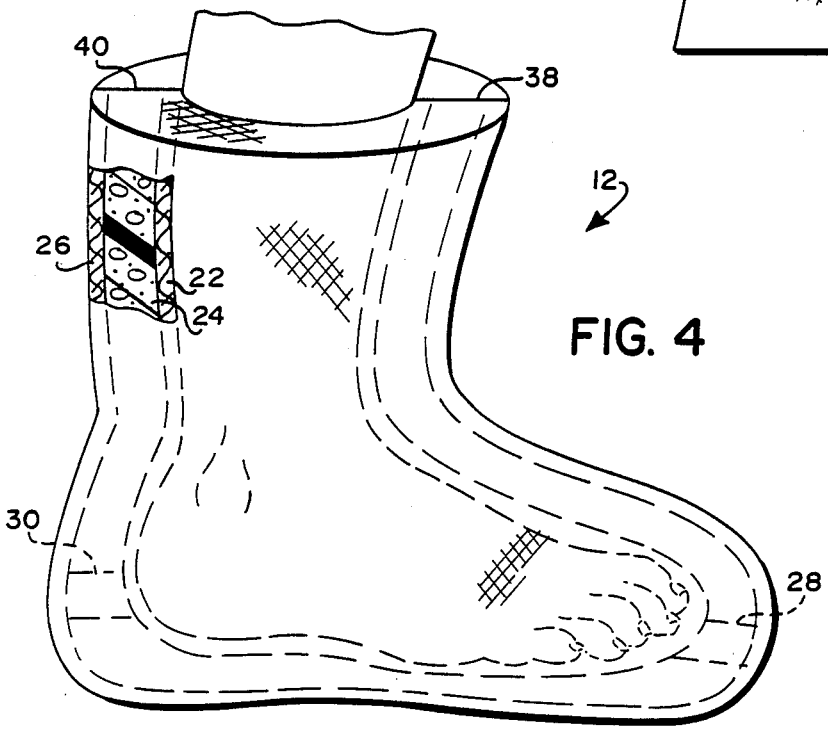
FIG. 4
FIG. 5
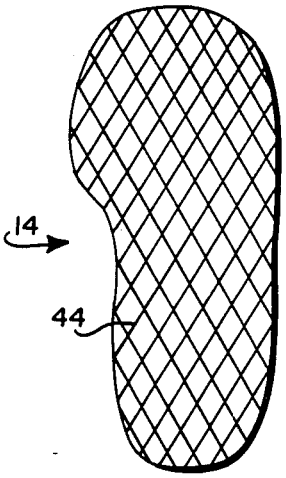
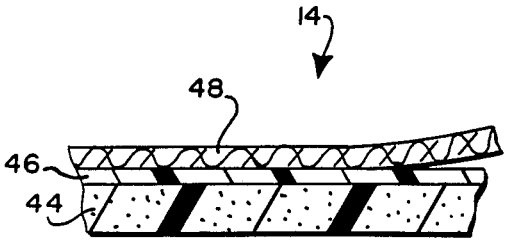
FIG. 6

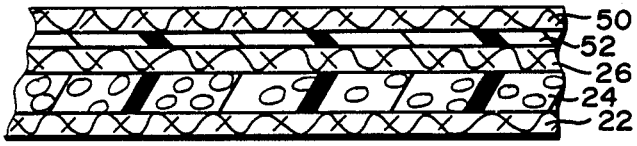
FIG. 7a
FIG. 8b
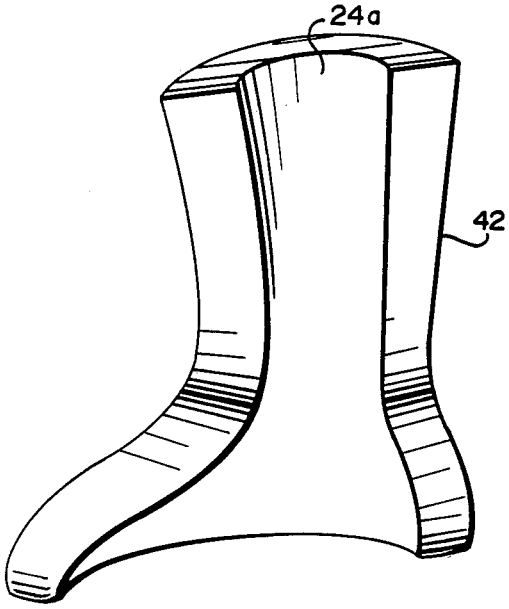
FIG. 8a
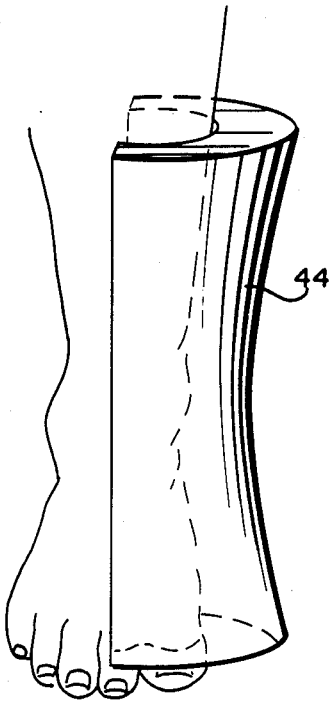
FIG. 8c
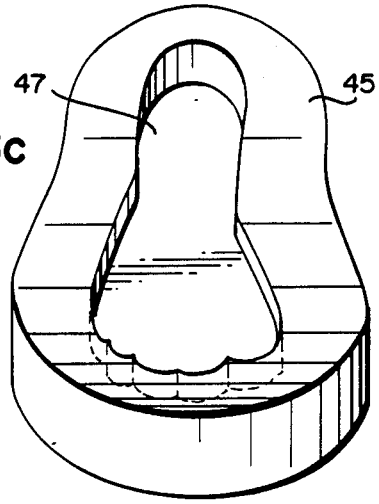

COLD WEATHER FOOTWEAR

BACKGROUND OF THE INVENTION

The present invention relates to cold weather footwear and particularly relates to footwear which has improved thermal insulation, moisture vapor transmission, wind resistance and water repellency characteristics.

In extremely cold conditions, the most important requirements for footwear in order to provide protection and/or comfort to the wearer are the reduction of heat loss from the foot and lower extremities and the controlled transmission of moisture produced through perspiration or enters from the outside environment. One system which meets these requirements is the Eskimo mukluk. This mukluk has an upper shell and a lower sole. The upper shell of the mukluk may be formed of soft leather, canvas or fabric, all of which are non-waterproof and necessarily breathable to permit moisture from perspiration to escape. The shell also provides sufficient insulation thickness. The mukluk soles, on the other hand, are waterproof and may be formed of animal hides. Thus, this combination keeps the foot dry as well as warm. A fur ruff is usually attached around the top of the mukluk to prevent snow from entering the footwear.

An accepted and successful improvement over the Eskimo mukluk was developed by adapting modern materials for those materials used by the Eskimos. Those changes included using: (1) soles from large overshoes or Army surplus winter footgear instead of tough animal hides for the mukluk bottoms; (2) nylon, polyester, or other breathable (but not waterproof) cloth instead of soft leather or canvas for the upper shells; and (3) a separate non-preformed "sock" for thermal insulation folded from a circular, square, or rectangular piece of $\frac{3}{4}$ to $1\frac{1}{4}$-inch, low-density polyurethane foam. However, that system has certain disadvantages. Specifically, that system, because of its express requirement for a "breathable," non-waterproof, outer shell resulted in both poor wind resistance and water repellency. Also, folding the foam sheet around the foot and then fitting the covered foot into the shell are difficult tasks to accomplish. In addition, the foam sheet tends to abrade and compact with use and must be unfolded and rotated regularly in order to retain its effectiveness. Furthermore, the mukluk of that system provides very little support to the wearer for stability and maneuverability. Finally, moisture from the wearer's foot may accumulate and freeze in the materials between the bottom of his foot and the inside of the sole, thereby reducing the effectiveness of the underfoot insulation. All of this is inconsistent with the idea of providing modern integrated cold weather footwear.

SUMMARY OF THE INVENTION

According to the present invention, there is provided multi-component footwear which integrates a preformed foam sock assembly, an insole assembly, and an outer boot comprised of a shell and sole into a modern cold weather footwear system and methods of forming and using components thereof. This multi-component integrated footwear system, through the use of modern materials and their unique construction and arrangement, provides cold weather footwear which, when the multiple components are used in combination, affords adequate thermal insulation and moisture vapor transport while providing excellent wind and water repellency characteristics. Additionally, the stability and maneuverability of the wearer of this footwear is enhanced in comparison with the prior Eskimo mukluk and the follow-on mukluk described above. The buildup of ice between the bottom of the wearer's feet and the sole which occurs with some frequency in cold weather footwear and which is a result of the accumulation of perspiration moisture from the wearer's feet or enters from the outside environment is readily controlled in the present system. This is accomplished by providing a removable insole which can be easily cleared of ice and reinserted into the footwear. Additional features include maximizing the abrasion resistance of those portions of the present footwear which provide for thermal insulation, avoiding temporary or permanent deformation of such portions, and facilitating the tasks of putting the footwear on the wearer's feet and taking the footwear off.

In a preferred form of sock assemby for this multi-component footwear system hereof, the sock assembly may be preformed to comprise essentially three layers, an inner lining, an intermediate layer, preferably formed of open cell polyurethane foam and an outer lining, preferably formed of a similar material as the inner lining. The inner lining may be a loosely-knit nylon or polyester tricot mesh fabric formed in the shape of a sock. Preferably, the inner lining has a moisture vapor transmission rate value of at least 1,000 $gm/m^2/24$ hours. The inner lining protects the intermediate foam insulation layer from abrasion, without inhibiting the transport of moisture vapor from the wearer's foot. Anchor tabs are preferably provided at the heel and toe extremities of the inner lining to secure the inner lining to the intermediate layer of the preformed sock.

The intermediate layer of the preformed sock is preferably an open cell polyurethane foam. Instead of a smooth surface on its opposite sides, the intermediate foam layer may be convoluted to increase flexibility, reduce material and weight. Various methods of forming the preformed sock may be adopted. For example, the sock may be formed of a one-piece material along a longitudinal plane and folded to form a sock shape. Preferably, the front and rear seams are bonded with adhesive rather than being stitched to avoid leakage of heat through the seams of the sock. Alternatively, the sock may be formed of discrete side portions and a bottom portion bonded one to the other along front and rear seams and bottom seams.

The outer liner for the preformed sock is preferably formed of a similar material as the inner liner and is formed in the shape of a sock. The outer liner may thus be slipped over the intermediate and inner liner subassembly and sewn to the inner liner adjacent the top of the sock. The outer lining similarly protects the intermediate foam layer of the sole against abrasion, while simultaneously permitting the transfer of moisture vapor from the wearer's foot.

A preferred form of the insole assembly includes an upper layer comprised of a moisture-trapping material and a lower layer comprised of two sub-layers, a first sub-layer formed of a closed cell plastic material, such as polyurethane foam, and a rigid non-porous material, such as plastic. The bottom or first sub-layer of the insole may be at least $\frac{3}{8}$ inch, preferably one inch, thick, affording substantial thermal insulation between the overlying foam sock assemby and the underlying sole.

On top of this first sub-layer is a rigid non-porous plastic sheet which serves to reduce the point loading on the closed cell foam sub-layer which may permanently deform, thereby reducing its effectiveness and, additionally, serves as a partial barrier to transmission of moisture vapor. The insole assembly provides a place for much of the moisture to collect where it can then be easily eliminated from the footwear. The upper layer of the insole is preferably comprised of a woven material for retaining or accumulating moisture and is separable from the lower layer. Alternatively, a molded or otherwise formed open-matrix, hydrophobic structure can be used. The open structure provides a place for the moisture to collect for easy removal. Should moisture from the individual's foot freeze in this woven insert, the insert can be removed from the footwear and any ice formations formed on or in the insert may be broken away by knocking the insert against a hard object.

The outer boot is preferably formed of a sole and an outer shell extending upwardly from and integrally connected with the sole. The outer shell is preferably formed of a nylon fabric backcoated preferably with a polyurethane coating having sufficient thickness to provide an air permeability value of less than two $ft^3/ft^2$/minute at a pressure of 0.5 inches of water. Water repellent may also be added to the nylon fabric. The backcoating thus permits transmission of moisture vapor and affords good wind resistance and water repellency. Various strapping and foxing may be applied to the boot to provide stability to the ankle area of the wearer of the boot.

Accordingly, it is a primary object of the present invention to provide a novel and improved cold weather footwear system affording good thermal insulation and moisture vapor transmission transport, while simultaneously providing sufficient wind resistance and water repellency characteristics.

It is another object of the present invention to provide an improved cold weather footwear system which minimizes or eliminates the problems of abrasion and deformation of the "sock" of the prior system discussed above by use of a preformed sock having inner and outer linings and a resilient intermediate foam layer, thereby allowing it to be preformed and readily slipped into the outer boot.

An additional object of the present invention is to provide a novel and improved cold weather footwear system wherein the buildup of ice between the bottom of the wearer's foot and the inside of the sole is controlled, the stability and maneuverability of the wearer of the boot is enhanced, the insulation under the foot where the foam sock may compress is maintained and the point loading on the separate and removable foam insole is minimized.

These and further objects and advantages of the present invention will become more apparent upon reference to the following specification, appended claims and drawings.

A further object of the present invention is to provide novel and improved methods of forming and using components of the cold weather footwear system hereof.

BRIEF DESCRIPTION OF THE DRAWING FIGURES

FIG. 3 is a plan view of the intermediate layer of the foam sock prior to forming the layer into the sock;

FIG. 4 is a perspective view of a preformed sock forming a part of the footwear hereof;

FIG. 5 is a top plan view of an insole for use with the footwear hereof;

FIG. 6 is a fragmentary enlarged cross-sectional view of the insole;

Figure 2:
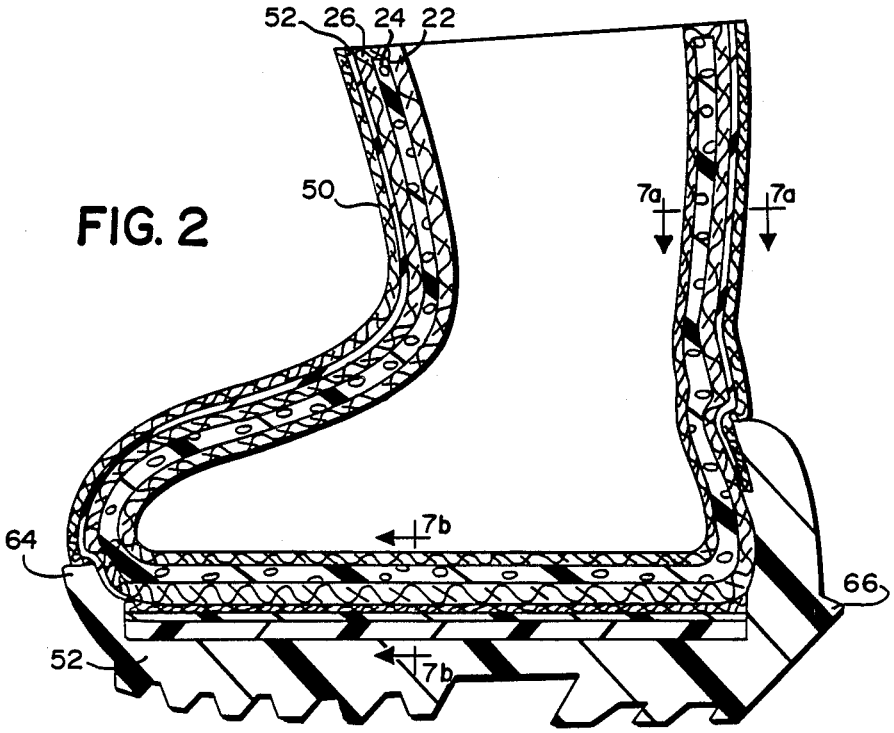
FIG. 2 is a vertical cross-sectional view thereof with various portions of the footwear having enlarged exaggerated thicknesses for clarity of illustration.

FIGS. *7a* and *7b* are enlarged fragmentary cross-sectional views of the footwear taken generally about on lines *7a—7a* and *7b—7b*, respectively, in FIG. 2; and FIGS. *8a–8c* are perspective views of another embodiment of the present invention illustrating the manner of forming the intermediate layer of the sock.

DETAILED DESCRIPTION OF THE DRAWING FIGURES

Reference will now be made in detail to the present preferred embodiment of the invention, an example of which is illustrated in the accompanying drawings.

Figure 1:
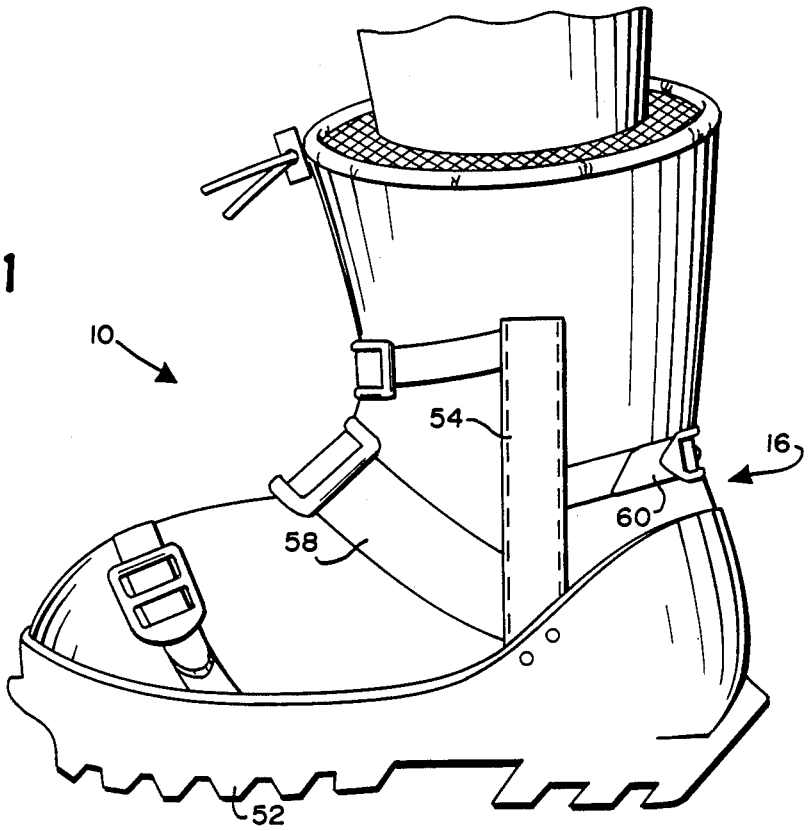
FIG. 1 is a perspective view of cold weather footwear constructed in accordance with the present invention.

Referring now to FIG. 1, there is illustrated cold weather footwear, generally designated 10, constructed in accordance with the present invention. Footwear 10 comprises a multi-component system, the three basic elements of which are a preformed sock, generally indicated 12 in FIG. 4, an insole generally indicated 14 and illustrated in FIGS. 5 and 6, and an outer boot, generally indicated 16 in FIG. 1, comprised of an integral outer shell and a sole. It will be appreciated that the improved cold weather footwear 10 of the present invention is adapted to encompass the foot, ankle and lower extremities of an individual's leg indicated 20 in FIG. 1.

Referring first to the preformed sock assembly illustrated at 12 in FIGS. 3 and 4, the sock assembly essentially consists of three parts; an inner liner 22, an intermediate insulation layer 24 and an outer liner 26. The inner layer is preferably a loosely-knit nylon or polyester tricot mesh fabric which is formed in the shape of a sock. The material forming the inner liner 22 is such that it preferably has a moisture vapor transmission rate value of at least 1000 $gms/m^2/25$ hours. An example of a material suitable for use as inner liner 22 is sold by Burlington Industries, Inc. under the designation "Style No. 18085." Anchor tabs 28 and 30 project from the toe and heel portions of the inner liner 22, respectively. The anchor tabs are used to anchor the extremities of the inner lining within the preformed sock, as described hereinafter.

The intermediate insulating layer 24 between the inner and outer linings, 22 and 26, respectively, of the sock assembly 12 preferably comprises a relatively thick layer of an open cell polyurethane foam. Preferably, the layer should have a thickness at least 1-inch and preferably about $1\frac{3}{4}$ inches. The inner and outer surfaces of the foam intermediate layer 24 may be smooth, however, the foam may be convoluted. When convoluted, the intermediate layer is afforded increased flexibility, and has reduced material and weight. Preferably, the foam insulation layer 24 should have an Indentation Load Deflection (ILD) value in the range of 12 to 40 pounds to provide adequate support and comfort for the wearer in use.

A preferred method of forming the intermediate insulating layer 24 is illustrated in FIG. 3 in conjunction with FIG. 4. In FIG. 3, the intermediate polyurethane foam layer 24 is first cut from a flat sheet of foam having the required thickness to an outline along opposite sides of a center axis A—A of the foot and ankle when viewed in side elevation. As indicated, the base or sole portion 32 is left uncut. It will be appreciated that the opposite side portions 34 and 36 of the flat sheet may be folded upwardly with the front and rear edges abutting to form front and rear seams 38 and 40, respectively, as illustrated in FIG. 4. That is, the front and rear edges of the mirror image outlines of the side portions 34 and 36, and which edges as will be recalled are preferably about $1\frac{3}{4}$ inch thick, may be butted one against the other. Thus, in forming the intermediate layer 24 of the preformed sock 12, the edges of the opposite side portions 34 and 36 are butted one against the other with adhesive therebetween such that the seams are bonded one to the other. As the edges of the side portions 34 and 36 are butted and bonded, anchor tabs 28 and 30 are disposed or pulled through the seam openings at the toe and heel portions, respectively, whereby the interior liner 22 may be secured within the foam sock layer.

The outer liner 26 of the preformed sock 12 may be formed of a similar material as the inner layer 22, i.e., a loosely-knit nylon or polyester tricot mesh fabric. The outer liner is similarly formed in a sock shape sufficiently large to slip over the intermediate foam layer 24 and interior liner 22 subassembly. To retain the intermediate insulating layer 24 between the inner and outer liners 22 and 26, respectively, the upper margins of the inner and outer liners adjacent the top of the interior liner 22 are sewn one to the other.

It will be appreciated that with the foregoing construction, the inner liner 22 provides abrasion protection for the foam insulation without inhibiting the transport of moisture vapor from the wearer's foot. Similarly, the outer liner 26 provides abrasion protection for the intermediate insulting layer of foam without inhibiting the transport of moisture vapor through the sock 12. Thus, the preformed sock 12 provides excellent thermal insulating characteristics while providing for moisture vapor transmission.

Referring to FIGS. 8*a* through 8*c*, there is illustrated an alternate form of construction for the intermediate layer 24*a* of the preformed sock 12. In this embodiment, the sock is constructed of three separate pieces of foam which are subsequently glued or bonded one to the other into a sock shape. Particularly, in this form, discrete side portions 42 and 44 are formed in the general outline of the opposite sides of the wearer's foot and ankle. A flat sole section 45 is formed in the general outline of the bottom of the wearer's foot. It will be appreciated that the juncture of side portions 42 and 44 forms front and rear seams and the juncture of the bottom section with the lower edges of the side portions forms a bottom seam. This sock may be formed by adhesively bonding the sections one to the other along the front, rear and bottom seams.

Referring now to FIGS. 5 and 6, there is illustrated an insole 14 which is disposed between the preformed sock and the bottom of the sole of the outer boot 16. The insole 14 is essentially formed of two pieces. The lower piece or layer (thermal insole) is comprised of a first sub-layer 44, which is preferably formed of a closed cell polyurethane, polyethylene, polypropylene or other foam material to provide thermal insulation between the foam sock assembly and the sole of the outer boot 16. The sub-layer 44 has a thickness at least $\frac{3}{8}$-inch and preferably about 1-inch. Bonded to the top surface of sub-layer 44 is a layer of sheet of rigid non-porous plastic material 46. The sheet material 46 overlays the sub-layer 44 to reduce point loading on the sub-layer 44. Additionally, the sheet layer 46 serves as a partial barrier to transmission of moiture vapor.

The second piece of insole 14 comprises an upper layer 48 (insole moisture trap). Upper layer 48 is generally comprised of a woven fabric insert which, for example, may be formed of a material sold by the Chicopee Company of Gainesville, Ga. under the tradename "SARAN." The woven insert 48 is provided to trap the moisture and thereby prevent it from being transmitted further into the footwear construction. The layer 48 is separable from layers 44 and 46. Thus, in the event of extreme cold and freeze-up of the moisture contained in the layer 48, the woven insert, or the entire insole 14, if desired, can be removed from the footwear. The insert may then be knocked or impacted against a hard object to knock the ice from it. After removal of the ice, the insert 48 can then be returned for disposition on top of layer 46 of insole 14 for reuse. If the entire insole 14 has been removed, it will be appreciated that the insert 48 may be cleared of ice as described and the insole assembly 14 readily and easily reinserted into the footwear. It will additionally be appreciated that the layers 44, 46, 48 are formed in the general outline of the lower surface of the individual's foot, as illustrated in FIG. 5, but with some peripheral enlargement to accommodate the larger outline of the inside of the molded sole 52, i.e., the outline of the individual's foot plus a 1 to $1\frac{3}{4}$ inch margin about its periphery.

Referring now to FIGS. 1 and 2, the outer boot 16 comprises an upper outer shell 50 and a lower sole 52. Preferably, the outer shell is formed of a nylon fabric and the lower sole 52 is formed of a one-piece molded polyurethane material. While other materials may be used, the shell 50 is preferably formed from commercially-available 420 denier, continuous filament, nylon warp yarn and 500 denier air textured nylon filling yarn woven in a plain weaving having sixty (60) ends and forty (40) picks per inch. Preferably, the nylon shell 50 is backcoated at 52 in FIG. 2 with a polyurethane. The coating is sufficiently thin such that moisture vapor may be transmitted from the interior to the exterior of the footwear. Thus, the moisture vapor passes through macroscopic holes formed in the coating during the backcoating process by the raised areas of the shell fabric. That is, the raised areas of the shell fabric create the macroscopic holes in the coating, enabling transmission of moisture vapor through such holes, as well as the microscopic pores inherent in the polyurethane material. The preferred nylon shell fabric with backcoating provides an air permeability value of less than 2 $ft^3/ft^2$/minute at a pressure of 0.5 inches of water. The fabric is also treated with a commercially-available water repellent whereby the outer shell 50 affords high wind resistance and water repellency.

Strapping and foxing are also provided on the boot 16. The foxing includes a pair of flat, semi-rigid plastic bars 54 which are anchored at their lower ends in the sole 52. The bars 54 extend upwardly along opposite sides of shell 50 above the ankle and provide vertical stability about the ankle area of the wearer. Front and back straps 58 and 60 are also provided about the shell 50. Each strap may be adjustable, for example by use of a buckle. The back or heel strap 60 provides control of the up and down movement of the heel. The three front straps are adjustable and provide foot and ankle support as they are tightened.

The outer shell 50 is preferably integrally formed with sole 52 during the molding process of the latter. The sole 52 has a cross-hatched angled pattern along its lower surface to provide good traction on ice and snow. Front and rear attachments 64 and 66, respectively, may also be provided for attachment to ski equipment.

It will be appreciated that the present invention provides improved cold weather footwear having good thermal insulation and moisture vapor transmission characteristics, while at the same time high wind resistance and water repellency are also provided. Additionally, the footwear system hereof accommodates the moisture vapor generated by perspiration from the individual's foot by permitting it to be transmitted to the environment through the multiple layers of the footwear, while simultaneously enabling the moisture accumulated within the boot to be confined to a specific area. That trapped moisture may be readily and easily removed, in the form of frost, ice or water droplets, for example by removing the upper layer of the insole or the entire insole assembly. By forming the upper layer of the insole of a woven fabric to trap the moisture, the frozen moisture may be readily removed simply by impacting the layer against a hard object. The combination of these subassemblies additionally affords cold weather footwear which is comfortable in extreme cold weather conditions, provides reduced heat loss from the foot, affords controlled moisture vapor transmission, and enhances the wearer's control and maneuverability.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Cold weather footwear comprising:

an outer boot;

a preformed sock disposed in said boot and formed of a material enabling transmission of moisture vapor therethrough; and an insole disposed between said sock and said boot, said insole comprised of a first portion formed to provide a barrier to the transmission of moisture vapor and a second portion formed of a moisture retaining non-adsorbent open matrix mesh material overlying said first portion and lying between the latter and said sock, said first portion being formed of a material affording thermal insulation and having an inability to retain, and trap or adsorb moisture and said second portion being formed of a material having the capacity to entrap moisture in its interstices substantially most of which, when frozen, may be released by mechanical action.

2. Footwear according to claim 1 wherein said second portion of said insole is removable from said footwear.

3. Footwear according to claim 1 wherein said first insole portion includes a first sub-layer of a thermally insulating, closed cell, non-adsorbent plastic material and a second sub-layer of a substantially rigid non-porous material providing a barrier to the transmission of moisture vapor.

4. Footwear according to claim 3 wherein said first sub-layer is comprised of a closed cell foam and said second sub-layer is comprised of a plastic material bonded to said first sub-layer.

5. Footwear according to claim 1 wherein said second insole portion is comprised of a hydrophobic material, said first insole portion including a first sub-layer of a closed cell plastic material and a second sub-layer of a substantially rigid non-porous material providing a barrier to the transmission of moisture vapor.

6. Footwear according to claim 5 wherein said first sub-layer is comprised of a closed cell foam and said second sub-layer is comprised of a plastic material bonded to said first sub-layer.

7. Footwear according to claim 6 wherein said second portion of said insole is removable from said footwear.

8. Footwear according to claim 1 wherein said second portion of said insole is removable from said footwear to enable mechanical removal of frozen entrapped moisture within said interstices.

9. Cold weather footwear comprising:

an outer boot;

a preformed sock disposed in said boot and formed of an open cell material enabling transmission of moisture vapor therethrough;

said sock including an intermediate layer having opposite side and bottom portions for encompassing and generally conforming to the shape of an individual's foot and ankle, an inner lining formed of a material enabling transmission of moisture vapor therethrough and substantially conformal to the shape of the inner surface of said intermediate layer, and an outer layer formed of a material enabling transmission of moisture vapor therethrough and substantially conformal to the shape of the outer surface of said intermediate layer; and an insole disposed between said sock and said boot, said insole comprised of a first portion formed to provide a barrier to the transmission of moisture vapor and a second portion formed of a moisture retaining material overlying said said first portion and lying between the latter and said sock.

10. Footwear according to claim 9 wherein each of said opposite side portions has front and rear edges and which edges engage the front and rear edges of the opposite side portion to form seams along the front and rear sides of the intermediate layer and means for securing the opposite side portions one to the other along said seams.

11. Footwear according to claim 9 wherein said securing means includes an adhesive.

12. Footwear according to claim 9 wherein each of said opposite side portions has front and rear edges and which edges engage the front and rear edges of the opposite side portion to form seams along the front and rear sides of the intermediate layer and means for securing the opposite side portions one to the other along said seams, said inner lining having at least one tab projecting from one of the toe or heel portions thereof and extending into the corresponding front or rear seam and means for securing the tab to the intermediate layer.

13. Footwear according to claim 9 wherein each of said opposite side portions has front and rear edges and which edges engage the front and rear edges of the opposite side portion to form seams along the front and rear sides of the intermediate layer and means for securing the opposite side portions one to the other along

UNITED STATES PATENT AND TRADEMARK OFFICE

CERTIFICATE OF CORRECTION

PATENT NO. : 4,845,862

DATED : July 11, 1989

INVENTOR(S) : JAMES G. PHILLIPS; SVEN E. OBERG; CYNTHIA D. WILDER; VINCENT F. AMBROSIANI

It is certified that error appears in the above-identified patent and that said Letters Patent is hereby corrected as shown below:

Cover page, item [75], correct the inventorship to include Vincent F. Ambrosiani.

Column 1, line 15, insert "which" between "or" and "enters".

Column 2, line 9, insert "which" between "or" and "enters".

Column 5, line 17, "seams" should read --edges--.

Column 9, line 22, "sheel" should read --shell--.

Column 10, line 26, "betweensaid" should read --between said--; line 47, "angle" should read --ankle--; line 62, "porton" should read --portion--.

Column 12, line 1, "saidsock" should read --said sock--.

Signed and Sealed this

Sixteenth Day of October, 1990

*Attest:*

HARRY F. MANBECK, JR.

*Attesting Officer*

*Commissioner of Patents and Trademarks*